United States Patent [19]

Tameo

[11] Patent Number: 4,652,208

[45] Date of Patent: Mar. 24, 1987

[54] ACTUATING LEVER FOR VARIABLE STATOR VANES

[75] Inventor: Robert P. Tameo, Peabody, Mass.

[73] Assignee: General Electric Company, Lynn, Mass.

[21] Appl. No.: 740,619

[22] Filed: Jun. 3, 1985

[51] Int. Cl.[4] ..... F04D 29/36

[52] U.S. Cl. ..... 415/162; 415/148; 416/500

[58] Field of Search ..... 415/157, 159, 162, 146, 415/147, 148, 149 R, 150, 160, 163, 151, 155; 416/500

[56] References Cited

U.S. PATENT DOCUMENTS

| | | | |
|---|---|---|---|
| 2,674,402 | 4/1954 | Cassie | 415/162 |
| 2,819,732 | 1/1958 | Paetz | 415/149 R |
| 3,356,288 | 12/1967 | Corsmeier | 415/149 |
| 3,376,018 | 4/1968 | Williamson | 415/149 R |
| 3,458,118 | 7/1969 | Burge et al. | 415/149 R |
| 3,588,269 | 6/1971 | Wall, Jr. | 415/161 |
| 3,779,665 | 12/1973 | Tatem et al. | 415/150 |
| 3,861,822 | 1/1975 | Wanger | 415/147 |
| 3,990,809 | 11/1976 | Young et al. | 415/160 |
| 4,558,987 | 12/1985 | Dittie | 415/162 |

FOREIGN PATENT DOCUMENTS

| | | | |
|---|---|---|---|
| 2078865 | 1/1982 | United Kingdom | 415/159 |
| 700686 | 12/1979 | U.S.S.R. | 415/149 R |

OTHER PUBLICATIONS

European Patent 43 452, Jan. 1982.

*Primary Examiner*—Robert F. Garrett
*Assistant Examiner*—John Kwon
*Attorney, Agent, or Firm*—Francis L. Conte; Derek P. Lawrence

[57] ABSTRACT

According to the present invention, there is provided an actuating lever for effecting concurrent vane rotation in tandem rows of variable stator vanes in a gas turbine engine. The actuating lever is interconnected between and operates to activate one vane in each of two axially adjacent vane rows with one free end of the lever being rotatably attached to an actuation ring and the other free end being secured to one of the vane spindles. The second vane spindle is attached at an intermediate position of the lever, and a flexible link section of the lever is provided between the two spindles to accommodate differential movements in the lever experienced during movement of the actuation ring.

34 Claims, 4 Drawing Figures

ACTUATING LEVER FOR VARIABLE STATOR VANES

BACKGROUND OF THE INVENTION

The present invention relates to vane operating mechanisms and more particularly to a lever arrangement for simultaneously actuating vanes in stator vane rows of a gas turbine engine.

Variable stator vanes are utilized in fans, compressors, and turbines of many gas turbine engines. The actuating mechanisms for these vanes conventionally include various operable combinations of levers, gears and articulated joints cooperating to rotate each vane about its rotation axis and driven by a unison ring or gear. In this respect, each row of variable stators is typically provided with a unison or actuation ring which, when rotatably moved, effects a concurrent rotatable movement of a vane through the interconnected actuating mechanism. The conventional vane actuating mechanisms are relatively complex in manufacturing, assembly and operation, and are subject to wear due to friction at joints thereof.

In the design of an advanced gas turbine engine it would be desirable to provide a new and improved vane actuating mechanism as provided by the present invention. The invention has particular utility when applied to tandenm variable stator vanes wherein a stationary stator vane row is typically provided upstream of a rotating blade row for suitably guiding airflow thereto. The tandem vane rows include two axially adjacent vane rows, instead of the one typically found in the prior art, to provide increased airflow guiding ability without undesirable performance losses therefrom which would otherwise occur in a single vane row rotated to relatively large guiding angles.

SUMMARY OF THE INVENTION

Accordingly, an object of the present invention is to provide a new and improved actuating lever assembly for variable stator vanes.

Another object of the present invention is to provide a new and improved actuating lever assembly for variable stator vanes which may be rapidly and easily interconnected between vanes to facilitate concurrent actuation thereof.

Another object of the invention is to provide a new and improved actuating lever assembly for variable stator vanes which is of a lightweight construction.

Another object of the invention is to provide a new and improved actuating lever assembly for variable stator vanes which avoids friction wear between moving parts associated therewith.

Another object of the invention is to provide a new and improved actuating lever assembly for variable stator vanes which may be efficiently and inexpensively manufactured.

The present invention is a new and improved actuating lever for simultaneously rotating a pair of variable stator vanes. In a preferred embodiment, the vanes are tandemly disposed and the lever includes first, second and third sections, and a link section joining the second and third sections. The first section is connectable to a unison member and the second section, and is also fixidly attached to a first variable vane. The third section is fixidly attached to a second variable vane. The link section is elastically flexible and accommodates differential movements between the second and third sections and causes the second vane to rotate as the first vane rotates.

DESCRIPTION OF THE DRAWING

The invention, together with further objects and advantages thereof, is more particularly described in the following detailed description taken in conjunction with the accompanying drawings in which.

DESCRIPTION OF THE PREFERRED EMBODIMENT

Figure 1:
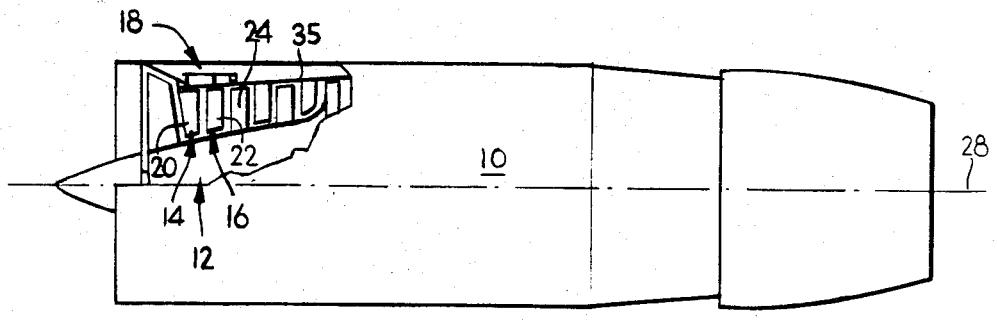
FIG. 1 is a partly sectional side view of an exemplary gas turbine engine having an actuating mechanism for simultaneously rotating vanes of two, tandem compressor stator vane rows in accordance with one embodiment of the invention.

Illustrated in FIG. 1 is an exemplary gas turbine engine 10 having a compressor 12. In accordance with one embodiment of the invention, the compressor 12 includes first and second, axially adjacent, or tandem, variable stator vane rows 14, 16, respectively, operatively connected to actuating means 18. The vane rows 14, 16 each includes a plurality of circumferentially spaced first vanes 20 and second vanes 22, respectively, the first vanes 20 being positioned upstream of the second vanes 22. Disposed downstream of the second vanes 22 is a row of rotatable compressor blades 24. Vane rows 14, 16 are axially adjacent and form a tandem vane cascade effective for providing predetermined airflow guiding to the compressor blades 24.

Figure 2:
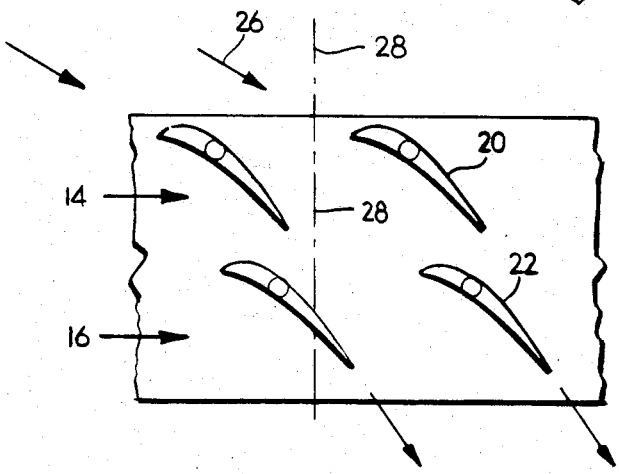
FIG. 2 is a diagrammatic plan view of a portion of the tandem vane rows of FIG. 1 rotated to a relatively closed setting.
Figure 3:
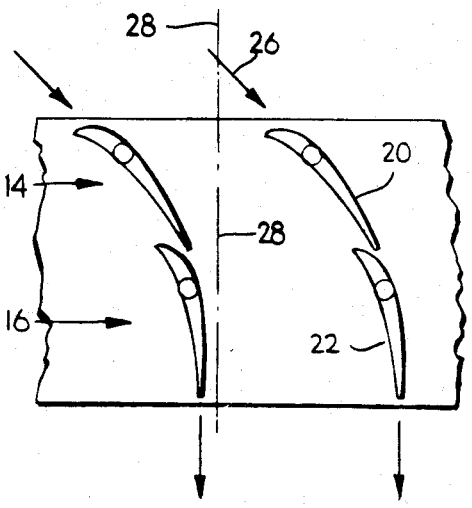
FIG. 3 is a diagrammatic plan view of a portion of the tandem vane rows of FIG. 1 rotated to a design setting with compressor air being discharged in a substantially rearward direction.

More specifically, FIG. 2 illustrates the vanes 20, 22 rotated about their radial axes to a relatively closed position wherein compressor airflow 26 enters first vanes 20 at an oblique angle to an engine longitudinal centerline axis 28, for example at about 55 degrees, and exits second vanes 22 at a similarly oblique angle, for example about 30 degrees. FIG. 3 illustrates the vanes 20, 22 rotated to a predetermined design setting wherein the compressor airflow 26 enters first vanes 20 at an oblique angle, for example about 45 degrees, and exits second vanes 22 at a reduced angle relative to the centerline 28, for example at about 10 degrees, or parallel thereto.

The use of tandem variable vanes rows 14, 16, instead of the one typically found in the prior art, allows for substantially larger airflow guiding angles through the vanes 20, 22 without the aerodynamic losses which would otherwise occur if a single vane row were utilized to obtain the relatively large guiding angle range between closed and design settings.

The present invention is directed to the design and use of the actuating means 18 for selectively controlling the rotatable adjustment of the vanes 20, 22.

Figure 4:
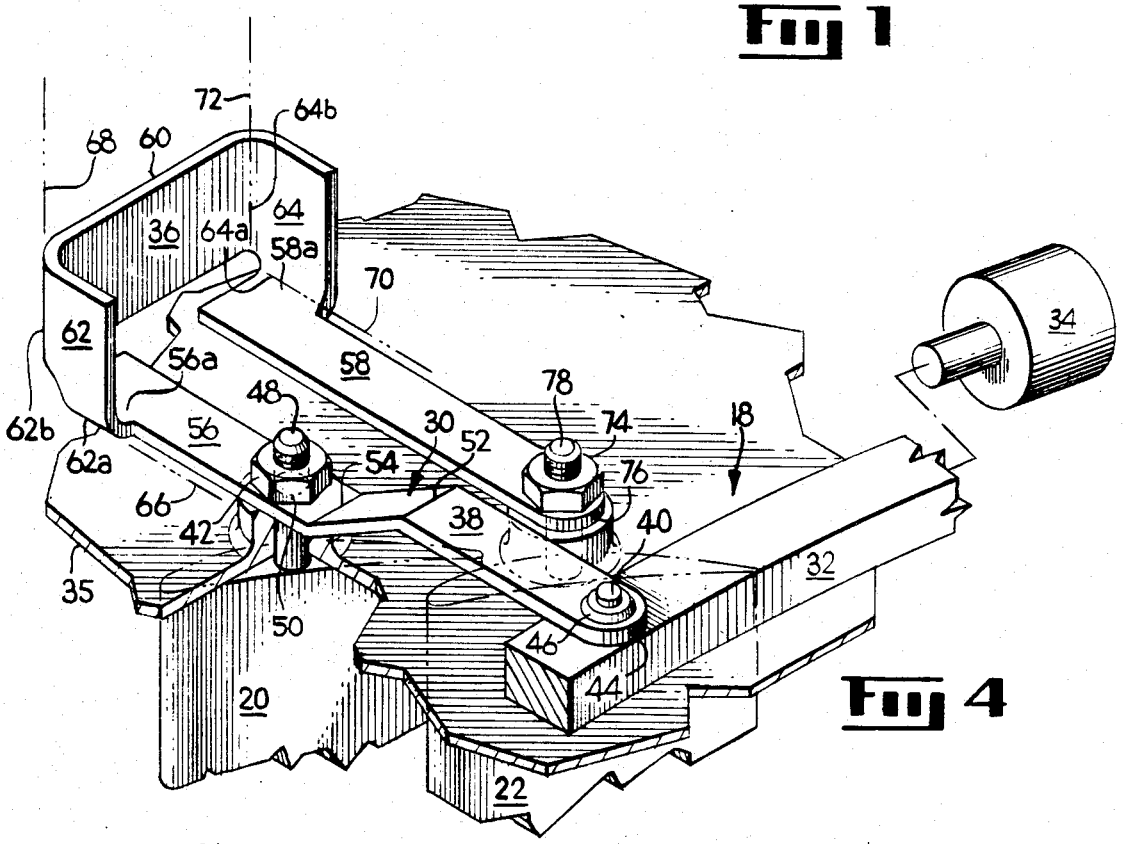
FIG. 4 is a three dimensional view of a portion of the actuating mechanism of FIG. 1 illustrating an actuating lever for the tandem variable stator vanes.

More specifically, and referring to FIG. 4, the actuating means 18 comprises a plurality of identical actuating levers 30 (only one of which is shown), in accordance with one embodiment of the invention, which are operatively connected to a conventional actuation or unison ring 32. The ring 32 is suitably connected to a conventional power means 34, which may be a hydraulic ram operable to rotate the ring 32 in opposite directions. The ring 32 is circumferentially positioned about an associated compressor casing or duct 35. The duct 35 is typically circumscribed by the ring 32 when the present invention is used is a gas turbine application, but those skilled in the art will recognize that the actuation ring 32 may extend only partially around the duct 35 without departing from the spirit of the invention. The ring 32 forms a part of the present invention to the extent that it serves as the operating means for the actuating lever 30, and no further discussion relative thereto will be provided.

As illustrated in FIG. 4, the actuating lever 30 is preferably of an integral U-shaped design. The lever 30 is particularly designed to include inherent flexural distortion means whereby an actuation of the lever 30 by the unison ring 32 may be accomplished to control vane angular positioning. The desired flexural distortion includes elastic bending and twisting which is provided by a design selection of the length, width and thickness, or thickness distribution, and geometry, of sections of the lever 30 to allow elastic deflections within the limits of motion. Such elastic deflections occur with respect to various pivot axes and occur primarily in a kinematic or flexural or link section 36 as will be subsequently described in greater detail.

The particular lever lengths, desired motions, and applied loads may be conventionally determined concurrently with the selection of the thickness distribution and widths of sections of the lever 30 to evaluate maximum stress due to kinematic motions, buckling loads and internal loads due to bending.

With further reference to FIG. 4, it will be noted that the actuating lever 30 includes a first section 38 which is defined as extending between a pair of connection points 40, 42. The first connection point 40 is the location where a first end 44 of the actuating lever 30 is rotatably attached to the actuation ring 32. Any conventional manner of attachment of the first end 44 of the lever 30 to the ring 32 is within the scope of the present invention, and for purposes of illustration, a spherical bearing 46 is illustrated. The second connection point 42 is the location at which a vane first spindle 48 forming a part of the first vane 20 extends through a first aperture 50 of the lever 30. As can be appreciated, the first spindle 48 is fixedly secured at the second connection point 42 to the lever 30 so that rotation of the lever 30 will effect a concurrent rotation of the first vane 20. Of course, any conventional and known attachment means can be utilized to effectively fixedly secure the first spindle 48 to the lever 30 at second connection point 42, a nut threadingly attached to the first spindle 48 is shown.

With specific reference to FIG. 4, it will be further noted that the first section 38 of the lever 30 may be angulated, i.e., provided with a step, as required due to space requirements to operably interconnect the ring 32 to the first spindle 48. In FIG. 4, this is illustrated as being accomplished by a pair of bend first and second axes or lines 52, 54 about which the first section 38 is bent during manufacture to create the step. While these bend axes 52, 54 are primarily provided for this purpose it can be appreciated that some elastic flexural movement between the lever 30 and the ring 32 may be afforded by the radial flexibility of the first section 38 about these axes, thereby to accommodate, in part, for bending loads in the first secton 38 and any differential movements which would tend to exist between the lever 30 and ring 32 during operation. Of course, the first section 38 is laterally rigid for transmitting a rotational force from the ring 32 to the first spindle 48.

The lever 30 may be further described as comprising a second section 56, a third section 58, and a fourth section integrally attached to and extending between the sections 56, 58 with such fourth section comprising the aforementioned kinematic or flexural link section 36. As illustrated in this embodiment, the fourth or flexural link section 36 is also a U-shaped construction to include a base portion 60 and two integral orthogonally extending first and second arms 62, 64 which are substantially parallel and coextensive with each other. The arms 62, 64 are substantially rigid and provide a generally rigid interconnection between the base portion 60 and the second and third section 56, 58.

The arms 62 and 64 are preferably generally rectangularly shaped in the embodiment illustrated with each having first and second orthogonal sides **62*a*, 62*b* and 64*a*, 64*b*, respectively. The first sides 62*a*, 64*a* are integral with respective sides 56*a*, 58*a* of the second and third sections 56, 58. The second sides 62*b*, 64*b* are integral with the base 60. This arrangement positions the arms 62, 64 perpendicular to both the base 60 and the second and third sections 56, 58 and defines first, second, third and fourth pivot axes 66, 68, 70, 72 at the sides 62*a*, 62*b*, 64*a* and 64*b***, respectively.

As illustrated, the pivot axes 66, 68 are substantially orthogonally aligned with respect to one another and further, the pivot axes 70, 72 are similarly orthogonally aligned. By this construction, the pivot axes 68, 72 are then in substantially parallel, vertical alignment with respect to radial axes extending up through the duct 35, while the pivot axes 66, 70 are in substantially parallel, horizontal alignment with the duct 35.

Accordingly, it can be seen that the second section 56 of the lever 30 is defined as that portion of the lever 30 extending from the connection point 42 to its end including side **56*a*. Similarly, the third section 58 is defined as extending from its end including side 58*a* to a third connection point 74 located at a second, free end 76 of the lever 30. The third connection point 74 comprises the fixed interconnection of the section end 76 with a second spindle 78 associated with the second stator vane 22. The second vane 22 is illustrated as being spaced circumferentially from the first vane 20, although any preferred spacing could be used depending on the particular design requirements. As with the means of interconnecting the first spindle 48 to the lever 30, the fixed securement of the second spindle 78 to the lever 30 may be by any conventional means which would permit a rotation of the second stator vane 22 in conjunction with a concurrent rotation of the third lever section 58 about the radial axis of the second spindle 78**.

With respect to the manner of operation of the actuating lever 30, it can be appreciated that the unison ring 32 may be rotated in a conventional manner to effect a concurrent actuation of a single vane 20 and, in turn, the rotation of a further single vane 22 in a tandem vane cascade. Of course, a plurality of the actuating levers 30 would be utilized to interconnect all of the tandemly positioned vanes 20, 22 in a now apparent manner. Inasmuch as each U-shaped actuating lever 30 is a single un-articulated member and is connected at the two points 42, 74, it will be understood that flexural distortion of the lever 30 will be required to permit and accommodate the simultaneous rotation of vanes 20, 22.

In particular, as the ring 32 is rotated by the power means 34, the first section 38 is caused to rotate and rotates first vane 20. As the first section 38 rotates, it simultaneously rotates the second section 56 fixedly and integrally attached thereto. For the second section 56 to rotate the third section 58 for rotating the second vane 22, the link section 36 appropriately elastically flexes.

More specifically, relative differential movement between the sections 56, 58 will be elastically accommodated primarily by elastic bending along the length of the link section 36 due to resultant bending moments located at the vertical pivot axes 68, 72 about which relative movement between the link section 36 and sections 56, 58 is obtained. Secondarily, the second and third sections 56, 58 are caused to elastically twist due to resultant twisting movements located at the horizontal pivot axes 66, 70 about which the relative twisting moment between the link section 36 and the sections 56, 58 is obtained.

Although sections 56 and 58 are designed to be relatively flexible for allowing this twisting they are also relatively rigid in their lateral extent to transfer the required rotational forces and movements between the two spindles 48 and 78. Lateral rigidity, with twisting flexibility, may be simply accomplished by a relatively large width-to-thickness ratio of the sections 56 and 58. Although the base 60 is relatively flexible with respect to its thickness for allowing transverse bending flexure thereof it is also relatively longitudinally rigid in compression and tension and laterally rigid in bending for transfering actuation force between the sections 56 and 58. This too may be accomplished by a relatively large width-to-thickness ratio of base 60.

The sections 56, 58 and 36 in combination with the pivoting connection points 42, 74 create a kinematic linkage which provides scheduling of the vane 22 turning angle as a function of the turning angle of vane 20. Variations of the lengths of the sections 36, 56, 58, as well as the relative orientations of these sections, provide the ability to modify the turning angle relationship between the respective vanes 20, 22, as will be apparent to those skilled in the art.

The lever 30 may be considered to be kinematically similar to 4-bar linkages known in the prior art inasmuch as it directly transfers rotation of the first spindle 48 to rotation of the second spindle 78. However, instead of using conventional articulated joints to connect the fourth section 36 to the sections 56 and 58, the section 36 is fixedly integrally attached thereto and allows movement as described above. This results in a lever 30, which is simpler and easier to manufacture than a conventional 4-bar linkage, and which eliminates friction wear by eliminating articulated joints.

With respect to the preferred embodiment of the invention as thus far described then, it should be realized that the optimum dimensional relationships for the parts of the actuating lever 30 under various operating parameters are within the intent and purview of the invention. For example, it will be noted that the dimensional thickness and widths for the lever 30 may be chosen by those skilled in the art to achieve the disclosed flexural and twisting characteristics while transferring the required forces to obtain desired rotations of the second spindle 78 with respect to the first spindle 48.

Inasmuch as the lever 30 may be preferably constructed as a single piece stamped and folded sheet metal fabrication due to the invention, it is low cost and easy to assemble. Furthermore, arm sides 62*a*, 62*b*, 64*a* and 64*b* not only act as the pivot axes 66, 68, 70, and 72, respectively, which with respect thereto the lever elastically bends and twists during rotation, but also may form the folding lines used in fabricating the lever 30.

Additionally, various alternate selections for the configuration of the flexural link section 36 are within the scope of the invention. A first alternate would involve constructing the flexural link section 36 of a material different from the material used in the construction of sections 56, 58. In such embodiment of the invention, it is apparent that the flexural link section 36 would have to be suitably bonded to the sections 56, 58 by some conventional means such as welding or diffusion bonding, for example. This alternate method of construction permits a material with lower or higher stiffness to be used as an alternative to or in addition to constructing the flexural link section of various widths and thicknesses to achieve the desired flexural characteristics.

For example, a material, such as titanium, having a relatively high yield strength to Young's modulus ratio is preferred for the link section 36. The sections 38, 56 and 58 are preferably also made from titanium, although other materials such as steel may be used to provide increased rigidity of these sections where desired. Such a material, e.g. titanium, allows relatively large strain prior to yielding which is desirable for accomodating the designed for bending and twisting of the sections 36, 56 and 58 in an elastic range.

While there have been described herein what are considered to be preferred embodiments of the invention, other modifications will occur to those skilled in the art after having considered the present disclosure. For example, generally similar levers 30 may be used for other variable vanes besides those in compressors, and may be used to rotate circumferential pairs, or larger groupings, of variable stator vanes which are not axially tandemly disposed. Furthermore, the arms 62 and 64 may be made relatively flexible to accommodate any twisting instead of allowing twisting of the sections 56 and 58.

Therefore, the foregoing is considered as illustrative only of the principles of the invention and accordingly, it is desired to secure by the appended claims all modifications falling within the true spirit and scope of the invention.

What is desired to be secured by Letters Patent of United States is:

1. An actuating lever for a pair of variable stator vanes, said lever being operably attachable to a first vane, a second vane and to a unison member said lever comprising:

a first section for operably connecting said unison member to said first vane;

a second section extending from said first section;

a third section operably connectable to said second vane; and flexural distortion means comprising a link section fixedly connected to said second and third sections, and being effective for elastically accommodating differential movements of said second and third sections and for obtaining simultaneous rotation of said first and second vanes.

2. An actuating lever according to claim 1, further including a first pivot axis disposed between one of said second and third sections and said link section about which relative movement therebetween is obtainable.

3. An actuating lever according to claim 2, further including a second pivot axis disposed between said one of said second and third sections of said link section about which relative movement therebetween is obtainable.

4. An actuating lever according to claim 3, wherein said first pivot axis and said second pivot axis are substantially orthogonally disposed to each other.

5. An actuating lever according to claim 3, wherein said first section is flexurally bendable to facilitate relative movement between said unison member and said first vane.

6. An actuating lever according to claim 1, wherein said first and second vanes are axially tandemly disposed.

7. An actuating lever according to claim 1, wherein said first, second, third and link sections are of an integral construction to form said actuating lever.

8. An actuating lever according to claim 1, wherein said lever includes a first free end forming a part of said first section, said first free end being operably connectable to said unison member, and further includes a second free end being operably connectable to said second vane.

9. An actuating lever according to claim 8, wherein first and second pivot axes are provided between one of said second and third sections and said link section about which relative movement between said one of said second and third sections and said kinematic link section is obtainable.

10. An actuating lever according to claim 9, wherein said first and second pivot axes are perpendicular to each other.

11. An actuating lever according to claim 1, wherein said flexural distortion means is also effective for obtaining twisting of said second and third sections.

12. An actuating lever according to claim 1, wherein said link section is of a flexible construction to facilitate flexural distortion during an operable movement thereof.

13. An actuating lever according to claim 12, wherein flexural distortion of said link section is operably controlled by varying dimensional parameters thereof.

14. An actuating lever according to claim 12, wherein flexural distortion of said link section is operably controlled by constructing said link section from a material other than the material forming said second and third sections.

15. An actuating lever according to claim 12, wherein said flexural distortion means provides relative movement between said link section and one of said second or third sections about a first pivot axis.

16. An actuating lever according to claim 15, wherein said flexural distortion means provides relative twisting movement between said link section and said one of said section or third sections about a second pivot axis disposed perpendicular to said first pivot axis.

17. An actuating lever according to claim 1, wherein said link section is generally U-shaped and comprises a base and first and second arms extending outwardly therefrom, each of said arms including first and second sides, said first arm sides of said first and second arms being connected to said second and third lever sections, respectively, and said second arm sides both being connected to said base, said first and second arm sides defining at least first and second pivot axes, respectively, about which relative movement between said link section and said second and third sections is obtainable.

18. An actuating lever according to claim 17, wherein said flexural distortion means includes varying dimensional parameters of said link section.

19. An actuating lever according to claim 18, wherein said dimensional parameters include at least a preselected thickness distribution of said link section.

20. An actuating lever according to claim 18, wherein said link section comprises a material other than material utilized for constructing said second and third sections of said actuating lever.

21. An actuating lever according to claim 20, wherein said link section material has a higher yield strength-to-Young's modulus ratio than that of said second and third sections.

22. An actuating lever comprising:

a second section having first and second opposite ends and first and second opposite sides;

a third section having first and second opposite ends and first and second opposite sides; and flexural distortion means comprising an elastically-flexible link section having first and second opposite ends, said link section first end being fixedly connected to said second section second end and said link section second end being fixedly connected to said third section first end.

23. An actuating lever according to claim 22 further including a first section extending from and fixedly connected to said second section first end, said first section being connectable to a member through which actuation force is transmittable to said lever.

24. An actuating lever according to claim 22 wherein said second section first end and said third section second end are connectable to first and second vanes, respectively, so that rotation of said second section rotates said first vane and rotation of said third second rotates said second vane, said flexural distortion means being effective to transfer actuation forces from said second section to said third section while elastically accommodating differential movements of said second and third sections and obtaining simultaneous rotation of said first and second vanes.

25. An actuating lever according to claim 22 wherein said link section comprises a base portion and first and second arms extending from opposite ends of said base portion, said link section first arm being fixedly connected to said second section second end and said link section second arm being fixedly connected to said third section first end.

26. An actuating lever according to claim 25 wherein said link section first arm is fixedly connected to said second section second end at only said second first side, and said link section second arm is fixedly connected to said third section first end at only said third section first side, and said second section second side is spaced from said third section second side.

27. An actuating lever according to claim 26 wherein said link section first arm and said link section second arm are disposed perpendicularly to said link base portion and are parallel to each other.

28. An actuating lever according to claim 25 wherein said link section first and second arms are substantially rigid and said link section base portion is flexible for allowing elastic bending along the length of said base portion.

29. An actuating lever according to claim 25 wherein said link section base portion is flexible for allowing elastic bending along the length of said base portion and said lever second and third sections are flexible for allowing elastic twisting thereof by said link section.

30. An actuating lever according to claim 29 wherein said link section base portion and said lever second and third sections each have a width and a thickness, said width being greater than said thickness.

31. An actuating apparatus, including a lever, comprising:

a second section having first and second opposite ends and first and second opposite sides;

a third section having first and second opposite ends and first and second opposite sides; and flexural distortion means for accommodating differential movements of said second and third sections and for transferring actuation forces between said second and third sections comprising a link section including:

a base portion having opposite ends;

a first arm; and a second arm;

said first and second arms extending perpendicularly outwardly from respective ones of said opposite ends of said base portion and parallel to each other; and said link first arm being fixedly connected to said second section second end at only said second section first side and said link second arm being fixedly connected to said third section first end at only said third section first side and said second section second side being spaced from said third section second side.

32. An actuating apparatus according to claim 31 wherein:

said link section base portion is flexible for allowing elastic bending between said opposite ends of said base portion;

said link section first and second arms are substantially rigid; and said lever second and third sections are flexible for allowing elastic twisting thereof by said link section.

33. An actuating apparatus according to claim 31 further including a first section extending from and fixedly connected to said second section first end and wherein:

said first section is connectable to a member through which actuation force is transmitted to said lever;

said second section first end and said third section second end are connectable to first and second stator vanes, respectively, so that rotation of said second section rotates said first vane and rotation of said third section rotates said second vane;

said link section base portion and said lever second and third sections each have a width and a thickness, said width being greater than said thickness; and said flexural distortion means being effective to transfer actuation forces from said second section to said third section while elastically accommodating differential movements of said second and third sections and obtaining simultaneous rotation of said first and second vanes.

34. An actuating apparatus according to claim 33 wherein said lever second and third sections are fixedly connected to said first and second stator vanes, and said first and second stator vanes are axially tandemly disposed to each other and adaptable for use without a rotatable blade row therebetween.

* * * * *